US005409272A

United States Patent [19]

McCormack

[11] Patent Number: 5,409,272

[45] Date of Patent: Apr. 25, 1995

[54] OVER-CENTER LATCH ASSEMBLY

[75] Inventor: Edward A. McCormack, Media, Pa.

[73] Assignee: Southco, Inc., Concordville, Pa.

[21] Appl. No.: 83,991

[22] Filed: Jun. 28, 1993

[51] Int. Cl.[6] ..... E05C 5/00

[52] U.S. Cl. ..... 292/66; 292/67; 292/229; 292/241; 292/DIG. 31

[58] Field of Search ..... 292/63, 44, 67, DIG. 31, 292/241, 73, 229, 197, 356, 62, 57, DIG. 72

[56] References Cited

U.S. PATENT DOCUMENTS

| | | | |
|---|---|---|---|
| 2,221,181 | 11/1940 | Dall | 292/DIG. 31 X |
| 2,559,736 | 7/1951 | Scarborough | 292/DIG. 72 X |
| 2,860,904 | 11/1958 | Barry et al. . | |
| 3,302,964 | 2/1967 | Barry . | |
| 3,402,958 | 9/1968 | Barry . | |
| 4,370,874 | 2/1983 | Munn | 292/DIG. 31 X |
| 4,510,779 | 4/1985 | Ahad | 292/DIG. 31 X |
| 4,693,503 | 9/1987 | Bisbing . | |
| 4,706,478 | 11/1987 | Swan et al. | 292/359 X |
| 4,763,935 | 8/1988 | Bisbing . | |
| 4,838,056 | 6/1989 | Weinerman et al. | 292/Dig. 31 X |
| 5,046,340 | 9/1991 | Weinerman et al. | 292/DIG. 31 X |

*Primary Examiner*—Rodney M. Lindsey

*Attorney, Agent, or Firm*—Paul and Paul

[57] ABSTRACT

A latch assembly is mounted in an aperture formed in a first member. The latch assembly includes a housing which is received within the aperture of the first member and includes an aperture extending therethrough. A slide is included which is received through the aperture of the housing. A pawl is also provided on the slide. A handle is pivotally attached to the slide for facilitating movement of the slide and pawl axially as the handle is pivoted between closed and opened positions. The pawl engages a second member in a latched position when the handle is pivoted to its closed position. The handle is also adapted for movement in a direction generally along a longitudinal axis thereof upon the closing and the opening of the handle which enables a first end of the handle to be positioned proximate to the housing when the handle is in its closed position. In the opened position, the handle is rotatable for facilitating rotatable movement of the pawl via the slide away from the second member and into an unlatched position. A sealing and biasing member is also included which provides both sealing of the aperture in the housing and for biasing the slide axially downward.

47 Claims, 4 Drawing Sheets

OVER-CENTER LATCH ASSEMBLY

BACKGROUND OF THE INVENTION

1. Field of the Invention

The present invention relates generally to latching devices and more particularly to over-center latch assemblies adapted for fastening hinged doors, panels and the like.

2. Brief Description of Prior Art

Presently, there are a number of over-center latch assemblies known in the art which are operable for securing two panels or a panel against a corresponding frame. Generally, latches of this type are mounted proximate the edges of the first panel and on engagement are adapted to compress the first panel against the corresponding second panel or frame and into the secured position. In such devices, a handle is provided which operates a pawl in order to compress the first panel against an inner surface of the second panel or frame. One type of over-center latch incorporates a lifting and turning motion of the handle for movement of the pawl into and out of engagement with the corresponding structure. Generally, a pivotal movement of the handle from an opened to a closed position corresponds with axial movement of the handle for compressing the panel or frame into the latched position. The handle when in its opened position is rotatable for effectuating corresponding rotatable movement of the pawl away from the second panel or frame structure and into an unlatched position for allowing the first panel to be opened.

One problem with such prior art designs is that dirt, water and other matter is able to pass through the latch and into the interior compartment of the first panel, thus possibly resulting in damage to the equipment contained therein. Another problem with such prior art latches occurs as a result of the connection of the handle within the latch housing. Specifically, the handle when in its closed position is received within the housing of the latch. However, the handle when in this closed position is positioned spaced from the housing which creates voids between the housing and handle of the latch. Such voids can cause the latch to be more conducive to receiving foreign matter therein and also works to adversely affect the appearance of the latch.

The present invention has been developed in view of the foregoing to overcome the deficiencies of the prior art.

SUMMARY OF THE INVENTION

The present invention provides a latch assembly for mounting in an aperture formed in a first member, for example a door, panel or the like, adapted for developing a compressive force between the first member and a corresponding second member, such as a second panel or frame, for releaseably retaining the first member against the second member and in a latched position. The latch assembly of the present invention includes a housing means which is provided with an aperture therethrough adapted for receiving a slide means. The slide means projects through the aperture of the housing means and is movable both axially and rotatably therein. A pawl means is also included associated with the slide means and is adapted for movement corresponding with movement of the slide means for releaseably retaining the second member. A handle means is also included which is pivotally attached to the slide means. The handle means is adapted to facilitate movement of the slide means and pawl means axially as the handle means is pivotally moved between closed and opened positions. The pawl means engages the second member in the latched position when the handle means is pivoted to its closed position. Means for imparting movement to the handle means in a direction generally along a longitudinal axis of the handle means upon the closing and the opening thereof is also provided. The handle means is rotatably movable when in the opened position for facilitating rotatable movement of the pawl means via the slide means away from the second member and into an unlatched position.

An object of the present invention is to provide a latch assembly incorporating an over-center latching action.

It is another object of the present invention to provide a latch assembly which is operable through lifting and turning motions of the latch handle.

It is a further object of the present invention to provide a latch assembly capable of preventing the passage of water, dust or other matter through the latch.

It is still a further object of the present invention to provide a latch assembly wherein the latch handle is positioned within the housing in the closed position of the latch so as to eliminate voids or spaces between the latch housing and handle.

It is still another object of the present invention to provide a latch assembly in which the parts are few and which provides a smooth latching operation.

These and other objects of the present invention will become more readily apparent when taken into consideration with the following description and attached drawings.

Figure 1:
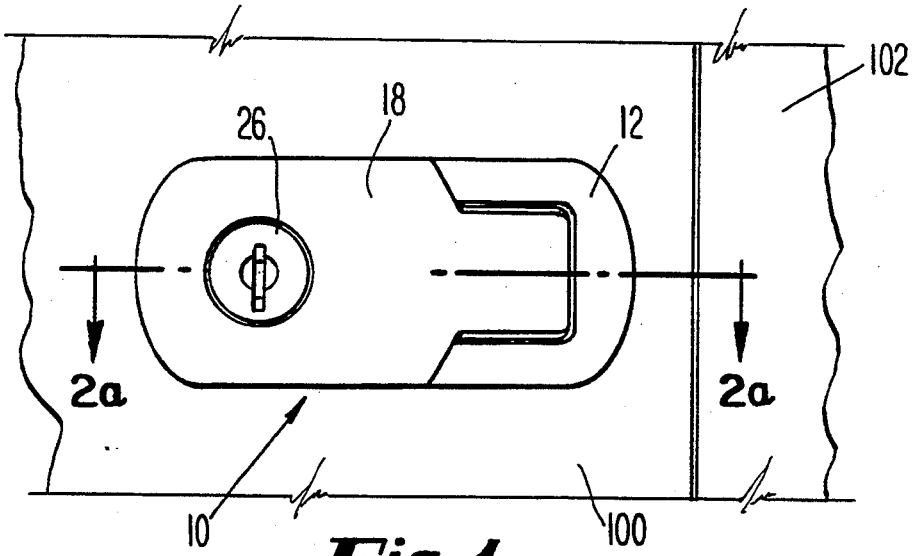
FIG. 1 is perspective view, partly broken away, showing a first member having a latch assembly according to the present invention mounted therein and in a latched position.
Figure 2A:
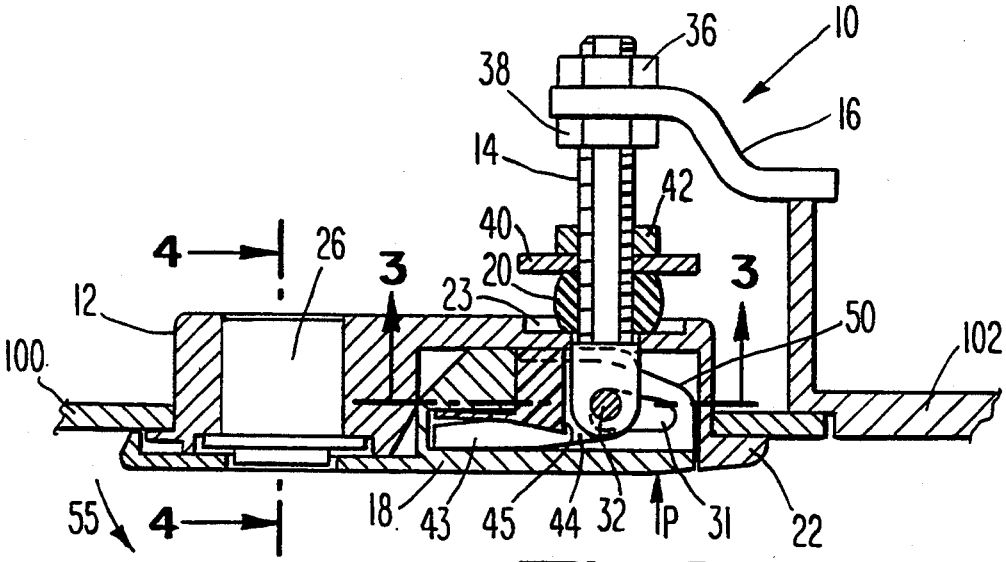

FIG. *2a* is a sectional elevational view of the latch assembly of FIG. 1 taken along in line *2a*—*2a*.

FIG. *2b* is a sectional elevational view of the latch assembly of FIG. *2a* showing a transition of its handle means from a closed to an opened position.

FIG. *2c* is a sectional elevational view of the latch assembly of FIG. *2b* showing the handle means in the opened position.

Figure 3:
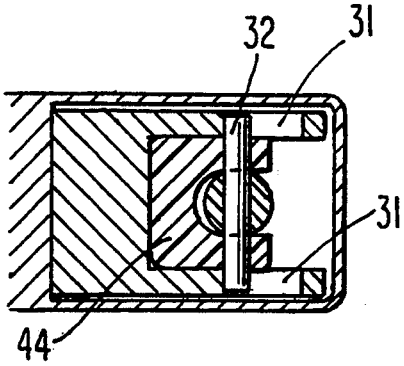
Figure 2B:
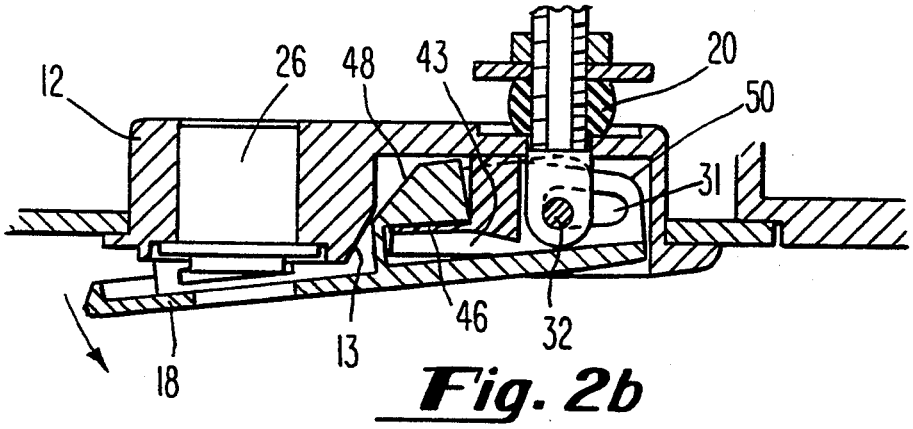
Figure 2C:
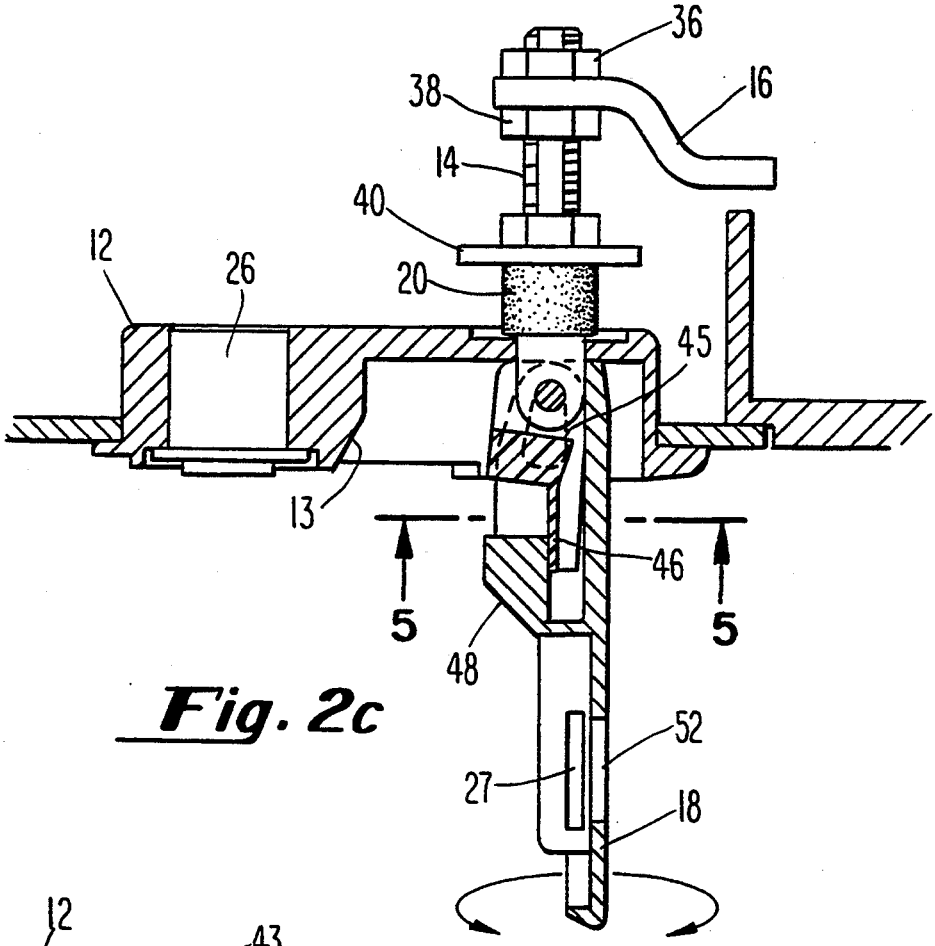

FIG. 3 is a sectional plan view of the latch assembly of FIG. *2a* taken along the line 3—3.

Figure 4:
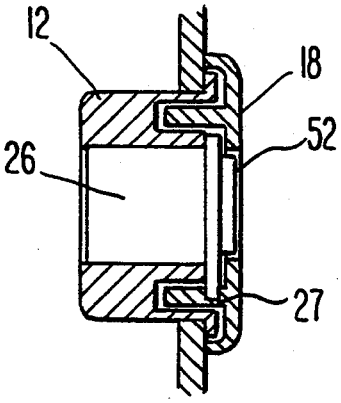

FIG. 4 is a sectional elevational view of the latch assembly shown in FIG. *2a* taken along the line 4—4.

Figure 5:
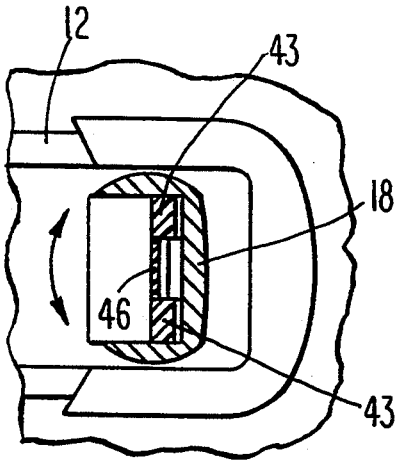
Figure 6A:
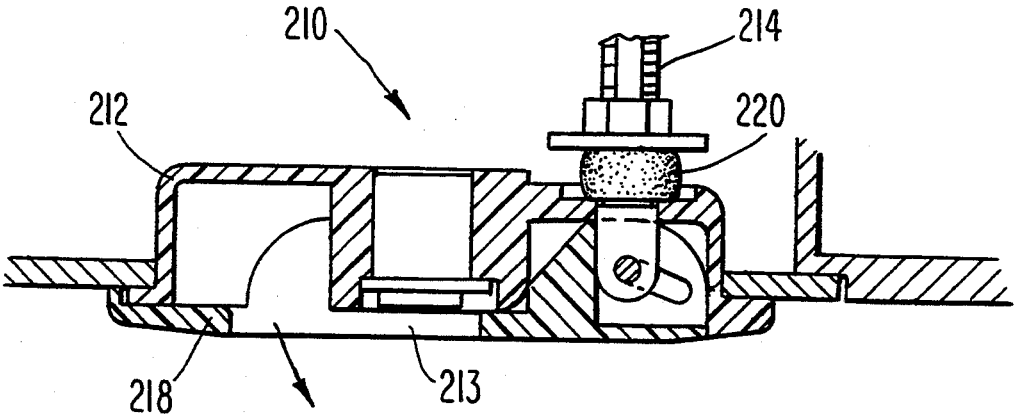
Figure 6B:
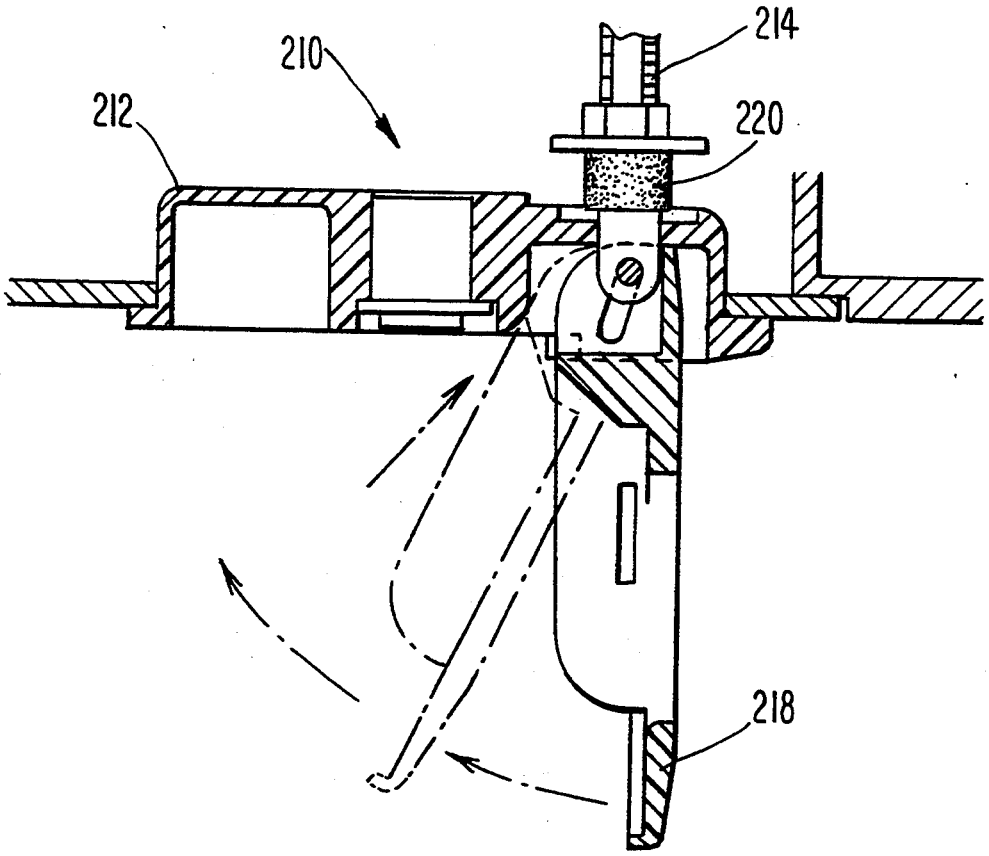
Figure 7A:
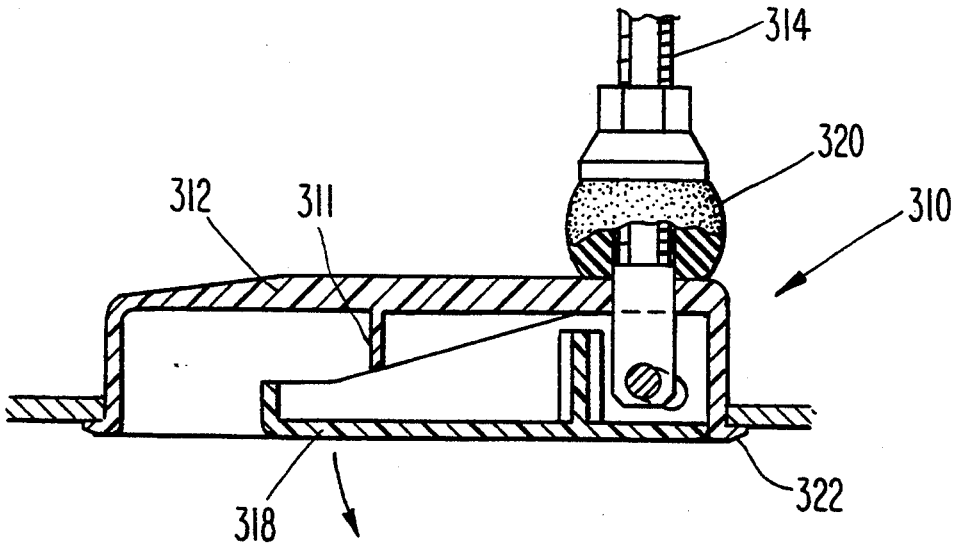
Figure 7B:
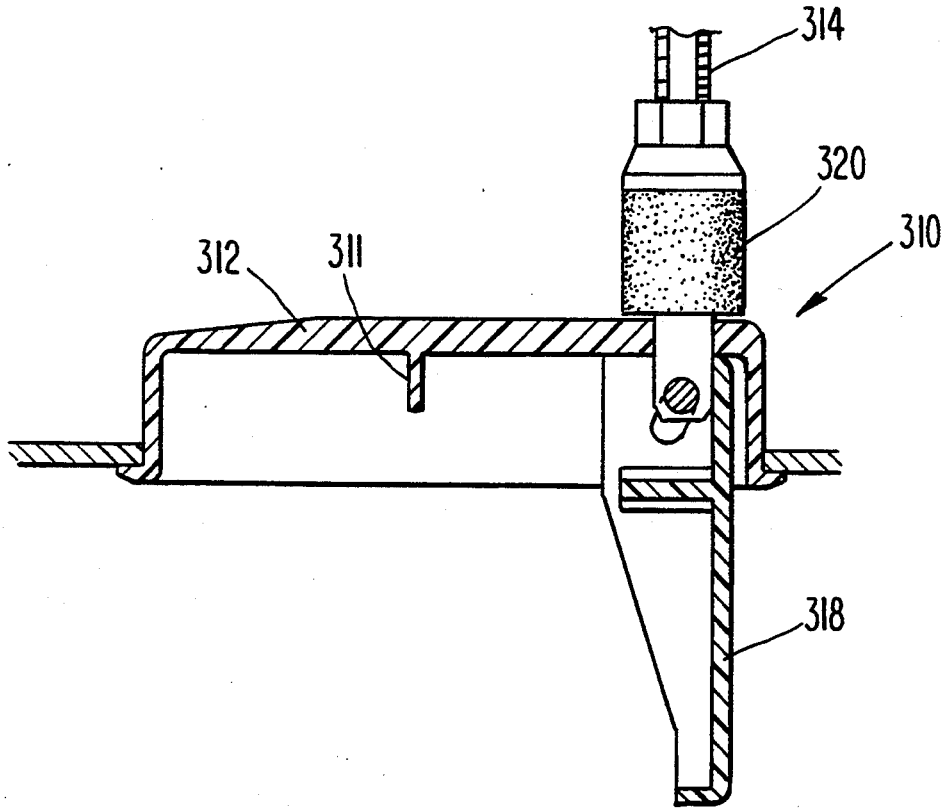

FIG. 5 is a sectional plan view of the latch assembly of FIG. *2c* taken along the line 5—5, with the handle means rotated 90° from the opened position.

FIG. *6a* is a sectional side elevational view of a second embodiment of a latch assembly according the present invention.

FIG. *6b* is a sectional side elevational view of the latch assembly of FIG. *6a* showing a transition of its handle means from an opened to a closed position.

FIG. *7a* is a section side elevational view of a third embodiment of a latch assembly according to the present invention.

FIG. *7b* is a sectional side elevational view of the latch assembly of FIG. *7a* showing its handle means in an opened position.

DETAILED DESCRIPTION OF THE PREFERRED EMBODIMENTS

Referring now to the drawings in detail, wherein like reference numerals indicate like elements throughout the several views, there is shown in 1, a perspective view, partly broken away of a first member 100 having a latch assembly 10 according to the present invention mounted therein. The first member 100, which can comprise a door, panel or the like fabricated from any suitable type of material, is adapted to engage a second member 102 in a closed position for enclosing various equipment which may be installed therein (not shown). The second member 102 can be comprised of a corresponding panel or frame structure, which also may be fabricated from any suitable type of material. As most clearly illustrated in FIGS. *2a–c*, the major components of the latch assembly 10 of the present invention are a housing means 12, a slide means 14, a pawl means 16, a handle means 18, and a sealing and biasing means 20. The housing means 12, as illustrated, is receivable within an aperture formed within the first member 100 for mounting of the latch assembly 10. The housing means 12 includes a flange 22 extending outwardly therefrom which is adapted to engage an outside surface of the first member 100 when mounted. An annular bore 23 is also provided formed within the housing means 12 proximate the first end thereof. An aperture is included extending through the housing means 12 and substantially within the center of the bore 23 for receiving the slide means 14. The housing means 12 is further included with an opening therein defining a cavity which is adapted for receiving the handle means 18. A bracket (not shown) can also be provided for securing the positioning of the housing means 12 within the aperture of the first member 100. The bracket is held within this position by a threaded mounting bolt. The bolt is inserted through an opening formed in the bracket and engages a threaded opening which can be formed in the bottom of the housing means 12.

The slide means 14 as shown is receivable within the aperture of the housing means 12. The slide means 14, as illustrated, includes a first portion which is in engagement with the aperture of housing means 12 when mounted, and a second portion which extends inwardly therefrom. The first portion of the slide means 14 is of a substantially cylindrical cross-section and includes therein a substantially cylindrical bore extending therethrough adapting for receiving and retaining a pin member 32 for a purpose described below. The second portion of slide means 14 is threaded for retaining the sealing and biasing means 20 and pawl means 16 also described below.

As shown in FIGS. *2a* and *2c*, the pawl means 16 is receivable onto the slide means 14 via an aperture formed therein. In the illustrated embodiment, the aperture is formed corresponding in configuration to the cross-section of the slide means 14 in order to insure proper orientation of the pawl means 16 upon installation. However, it should be understood that the aperture can be comprised having any suitable configuration. The pawl means 16 is retained in the illustrated position on the slide means 14 by a pair of threaded nuts 36, 38.

As illustrated in FIG. *2a*, the sealing and biasing means 20 is receivable onto the slide means 14 and is retained in a position abutting the housing means 12 adjacent the bore 23 therein by a support means 40. The sealing and biasing means 20 of the present invention comprises an elastic member, preferably manufactured of neoprene, however other suitable materials can also be provided. The support means 40 as shown generally comprises a washer member which is adapted to compress the sealing and biasing means 20 against the housing means 12. The support means 40 is retained within the illustrated position on the slide means 14 by a threaded nut 42. The position of the support means 40 is adjustable by the threaded nut 42 to vary the tension on the sealing and biasing means 20 when in the latched position. In some instances, the support means 40 can be positioned abutting the housing means 12 for completely covering the bore thereof in the latched position of the latch assembly 10.

The handle means 18, as best illustrated in FIGS. *2a* and *b*, is provided having a pair of generally elongated, diametrically opposing cavities 31 therein (only one of which is visible), proximate its front end, which are adapted for receiving the pin member 32 on assembly. In the illustrated embodiment, a cam member 44 is also included mounted on the pin member 32 between the slide means 14 and the handle means 18. Preferably, the cam member 44 is manufactured of Delrin, however, other suitable materials can also be provided for this same purpose. The cam member 44, as best shown in FIGS. *2a* and 3, is provided with a bore therethrough for mounting on the pin member 32, and includes a substantially planar portion 43 adapted for being received within the handle means 18. The handle means 18 is included with a bore therein proximate its first end configured to receive the substantially planar portion of the cam member 44 as described below. The cam member 44 is also included with a biasing means 46 integral with the planar portion 43 thereof adapted for engaging a boss 45 of the handle means 18.

The handle means 18, as best shown in FIGS. *2b* and *c*, is further provided with a substantially inclined first cam 48 adapted for engaging a substantially declined cam surface 13 of the housing means 12, and also a substantially radiused second cam surface 50 positioned proximate its front end. Furthermore, as shown in FIGS. *2c* and 4, the handle means 18 can also be included with an opening 52 formed therein which is adapted for receiving a locking means 26 which is provided within the housing means 12, in the closed position thereof. The locking means 26 is rotatable within the housing for engaging a generally elongated slot 27 formed in the handle means 18 when in the closed position for locking the device.

In operation, pivotal movements of the handle means 18 corresponds with axial movements of the pawl means 16 via the slide means 14. In the closed position of handle means 18, as shown in FIG. *2a* the pawl means 16 is in engagement with the second member 102. In this position, the outer surface of the handle means 18 is contiguous with the outer surface of the flange 22 of the housing means 12. Upon pivotal movement of the handle means 18 from the closed position to the opened position, the handle means 18 is also moved backwardly along its longitudinal axis due to the engagement of the pin member 32 within the elongated cavities 31 of the handle means 18. In the present embodiment, the first cam surface 48 of the handle means 18 allows movement of the handle means 18 from the closed position to a position illustrated in FIG. *2b*, in which the operator can grab the handle means 18 for movement to the opened position shown in FIG. *2c*. Specifically actuation by the operator downward in the direction of arrow P upon the handle means 18 proximate its first end will cause movement upwardly in the direction of arrow 55 of the second end of the housing means 18 due to the slope of the substantially radiused second cam surface 50. Furthermore, the second cam surface 50 will also facilitate the rearward movement of the handle means 18 during the opening thereof, however it should be understood that the second cam surface 50 is not required for such movement to occur. Similarly, upon pivotal movement of the handle means 18 from the opened position shown in FIG. *2c* to the closed position of FIG. *2a*, the handle means 18 will move forwardly along its longitudinal axis by the action of the pin member 42 within the elongated cavities 31. This forward longitudinal movement is aided by the contact of the first cam surface 48 against the cam surface 13 of the housing means 12, however, similar to that described above, such is not required for such movement to occur.

As best illustrated in FIGS. *2a* and 3, the substantially planar portion 43 of the cam member 44 is received within the bore of the handle means 18, with the boss 45 in engagement with the biasing means 46. The force of the biasing means 46 on the boss 45 of the handle means 18 will work to prevent extraneous rattle of the handle means 18 and will also assist in motion control during movement of the handle means 18 between the opened and the closed positions.

As best illustrated in FIGS. *2c* and 5, rotation of the handle means 18 when in its opened position will correspond with movement of the pawl means 18 via the slide means 14 away from the second member 102 and into an unlatched position for allowing opening of the first member 100.

The aforementioned elements of the latch assembly 10 of the present invention can be molded or otherwise formed by conventional techniques from any suitable material, for example, die cast, stainless steel, Delrin, nylon, etc.

The latch assembly of the present invention posseses several advantages over conventional latch assemblies. A particular advantage is that the present invention is adapted to prevent the passage of water, dust or other matter through the latch and into the interior compartment of the first member 100 by the operation of the sealing and biasing means 20. In addition, as best seen in FIG. *2a*, the flange 22 of the housing means 12 preferably is of a sufficient size for preventing the passage of water, dust or other matter around the latch and through the aperture in the first member 100 when the flange 22 is in engagement with the outer surface of the door 100. A gasket or the like can also be provided positioned between the flange 22 and first member 100 for providing additional sealing thereof.

In addition, the present invention provides another advantage over the prior art in that the sealing and biasing means 20 also functions as the operating spring for the latch. Specifically, during operation, the sealing and biasing means 20 will operate to exert force downwardly in the axial direction of the slide means 14 during the movement of the handle means 18. This will force the handle means 18 into contact with the housing means 12 adjacent the cavity thereof. As such, during operation, the pin member 32 will be moved within the cavities 31 upon movement of the handle means 18.

Another advantage of the present invention over prior art devices is that the voids or spaces between the handle means and the housing means which are present in conventional devices are eliminated by the present invention, thus improving both the operability and the appearance of the device. As indicated earlier, the combination of the elongated cavities 31 in the handle means 18 and the pin member 32 provides movement forward and rearward along the longitudinal axis of the handle means 18 during the opening and the closing thereof. Specifically, as shown in FIG. *2c*, in the opened position of the handle means 18, the pin member 32 is adjacent the first ends of the elongated cavities 31, and in the closed position of the handle means 18 shown in FIG. *2a*, the pin member 32 is adjacent the second ends of the elongated cavities 31. As such, in the closed position of the handle means 18, as shown in FIG. 1, the first end of the handle means 18 is positioned adjacent the first end of the housing means 12, and the handle means 18 completely covers the cavity formed within the housing means 12.

Still another advantage of the latch assembly of the present invention is that the cam surfaces 48 and 50 disposed within the handle means 14, and the cam surface 13, disposed within the housing means 12, will facilitate the longitudinal movements of the handle means 18 which will work to improve operability of the latch.

It is another advantage of the latch assembly of the present invention to provide a cam member 44 which will operate to both prevent extraneous rattle of the handle means 18 during movement, and will also assist in motion control of the device.

In FIGS. *6a* and *b*, is illustrated a second embodiment of the latch assembly according to the present invention. In this second embodiment, portions identical to that shown in relation to the first embodiment are designated with a corresponding number beginning with the number 200. As illustrated, the latch assembly 210, similar to that described above, includes a housing means 212, slide means 214, pawl means (not shown), handle means 218, and sealing and biasing means 220. Although not described here in detail, the handle means 218 is movable between the positions shown in FIGS. *6a* and *6b* consistent with that described in relation to the first embodiment. However, different from that disclosed in the previous embodiment, an aperture 213 is provided within the handle means 218, in order to accomodate movement by the operator from the closed to the opened position. In this second embodiment, the cam member 44, as disclosed in the first embodiment, is not shown, however, such may be provided, if desired, in some circumstances.

In FIGS. *7a* and *7b* is shown a third embodiment of the present invention. In this embodiment, portions corresponding with the earlier two embodiments are designated with the number 300. In this embodiment, the latch assembly 310 includes a housing means 312, slide means 314, pawl means (not shown), handle means 318 and sealing and biasing means 320 are shown. As shown in FIG. *7a*, the length of the handle means 318, contrary to the earlier two embodiments, does not extend the total length of the cavity of the housing means 312. However, the first end of the handle means 318 is positioned adjacent the first end of the housing means 312 in the closed position. The housing means 312 is also included with a boss 311 extending upwardly from the bottom of the cavity of the housing means 312. As such, the handle means 318 in the closed position is in engagement with the boss 311 of the housing means 312. This will work to position the outer surfaces of the flange 322 of the housing means 312 and the handle means 318 contiguous to one another.

It will be recognized by those skilled in the art that changes may be made by the above-described embodiments of the invention without departing from the broad inventive concepts thereof. For example, the support means, which is shown as a substantially circular member, can be formed of a star or other configuration adapted to engage a correspondingly configured aperture or apertures formed in the bottom of the housing means for engagement in the latched position of the latch assembly. In addition, the handle means can be formed having any suitable length or configuration in order to cover any specified amount of the housing in the closed position of the latch. Furthermore, the latch can be constructed such that the front of the handle means is abutting or spaced from the front of the housing in the closed position of the handle means. In addition, the cam member, as disclosed in the first embodiment, can also be incorporated within the second two embodiments for the same purpose. It is understood, therefore, that this invention is not limited to the particular embodiments disclosed, but it is intended to cover all modification which are within the scope and spirit of the invention as defined by the appended claims.

What I claim is:

1. A latch assembly for mounting in an aperture formed in a first member adapted for developing a compressive force between the first member and a corresponding second member for releasably retaining the first member against the second member and in a latched position, the latch assembly comprising:

housing means including an aperture extending therethrough;

slide means adapted to project through the aperture of the housing means, movable axially and rotatably therein;

pawl means associated with the slide means and adapted for axial and rotatable movement corresponding with movement of the slide means for releasably retaining the second member;

handle means pivotally attached to the slide means, the handle means being adapted to facilitate movement of the slide means and pawl means axially as the handle means is pivotally moved between closed and opened positions, the pawl means engaging the second member in the latched position when the handle means is pivoted to its closed position;

means for imparting movement to the handle means in a direction generally along a longitudinal axis of the handle means upon the closing and the opening thereof, wherein the handle means is pivotally secured by a pivot pin to the slide means and includes therein a generally elongated cavity through which the pivot pin passes, with the generally elongated cavity including as portions thereof a first end and a second end at a spaced separation and the spaced separation being generally greater than diameter of the pivot pin, the pivot pin being closer to the first end of the generally elongated cavity than the second end thereof in the opened position of the handle means and closer to the second end of the generally elongated cavity than the first end thereof in the closed position of the handle means for imparting said movement to the handle means; and the handle means being rotatably movable when in the opened position for facilitating rotatable movement of the pawl means via the slide means away from the second member and into an unlatched position.

2. A latch assembly according to claim 1, wherein the movement of the handle means is forward along the longitudinal axis thereof toward a first end of the handle means upon the pivotal movement of the handle means from the opened to the closed position, and wherein the movement of the handle means is rearward along the longitudinal axis thereof toward a second end of the handle means upon the pivotal movement of the handle means from the closed to the opened position.

3. A latch assembly according to claim 1, further including locking means adapted for retaining the handle means in the closed position.

4. A latch assembly according to claim 1, wherein the housing means further includes a first end and a second end, and the handle means includes a first end and a second end along the longitudinal axis thereof, wherein the first end of the handle means is positioned adjacent the first end of the housing means in the closed position of the handle means.

5. A latch assembly according to claim 1, wherein the handle means further includes cam means adapted for facilitating the longitudinal movements of the handle means.

6. A latch assembly according to claim 5, further including biasing means associated with the cam means adapted for both providing additional resistence to the handle means upon movement between the opened and the closed positions and for restricting the movement of the handle means when in the closed position thereof.

7. A latch assembly according to claim 6, wherein the biasing means is a spring member integral with the cam means.

8. A latch assembly according to claim 5, wherein the cam means includes a first cam surface for facilitating movement of the handle means longitudinally forward toward a first end of the housing means during the closing thereof and a second cam surface for facilitating movement of the handle means longitudinally rearward toward a second end of the housing means during the opening thereof.

9. A latch assembly according to claim 1, further including cam means adapted for facilitating movement of the handle means from the closed to the opened position, whereby upon actuation by an operator downward on the latch assembly adjacent a first end of the handle means, a second end of the handle means is moved upwardly a sufficient amount from the closed position to a position in which the operator is capable of grabbing the handle means for movement to the opened position.

10. A latch assembly according to claim 9, further including biasing means associated with the cam means adapted for both providing additional resistence to the handle means upon movement between the opened and the closed positions and for restricting the movement of the handle means when in the closed position thereof.

11. A latch assembly according to claim 10, wherein the biasing means is a spring member integral with the cam means.

12. A latch assembly according to claim 1, wherein the housing means further includes both an opening therein defining a cavity adapted for receiving the handle means in the closed position thereof and flange means, with the housing flange means and the handle means both being provided with substantially flat outer surfaces which are contiguous with each other when the handle means is in the closed position.

13. A latch assembly according to claim 1, wherein the handle means is provided with an aperture therein engageable by an operator to accommodate movement by the operator from the closed position to the open position.

14. A latch assembly according to claim 1, further comprising means adapted for both sealing the aperture of the housing means so as to prevent the passage of matter therethrough and for biasing the slide means axially downward so as to urge the handle means into contact with the housing means upon pivotal movement thereof.

15. A latch assembly according to claim 14, further comprising support means associated with the slide means adapted to retain the sealing and biasing means in a position abutting the housing means of the latch assembly.

16. A latch assembly according to claim 15, wherein the sealing and biasing means is an elastic member adapted to be compressed by the support means against the housing means of the latch assembly.

17. A latch assembly according to claim 14, wherein the housing means further includes flange means extending outwardly a sufficient amount therefrom adapted for engaging an outside surface of the first member for preventing the passage of matter around the latch assembly and through the aperture in the first member when the latch assembly is mounted therein.

18. A latch assembly for mounting in an aperture formed in a first member adapted for developing a compressive force between the first member and a corresponding second member for releasably retaining the first member against the second member and in a latched position, the latch assembly comprising:

housing means including an aperture extending therethrough;

slide means adapted to project through the aperture of the housing means, movable axially and rotatably therein;

pawl means associated with the slide means and adapted for axial and rotatable movement corresponding with movement of the slide means for releasably retaining the second member;

handle means pivotally attached to the slide means, the handle means being adapted to facilitate movement of the slide means and pawl means axially as the handle means is pivotally moved between closed and opened positions, the pawl means engaging the second member in the latched position when the handle means is pivoted to its closed position;

the handle means being rotatably movable when in the opened position for facilitating rotatable movement of the pawl means via the slide means away from the second member and into an unlatched position; and means adapted for both sealing the aperture of the housing means so as to prevent the passage of matter therethrough and for biasing the slide means axially downward so as to urge the handle means into contact with the housing means upon pivotal movement thereof, wherein the sealing and biasing means of the latch assembly comprises an elastic member;

the latch assembly further comprising support means associated with the slide means adapted to retain the sealing and biasing means in a position abutting the housing means of the latch assembly, wherein the sealing and biasing means is adapted to be compressed by the support means against the housing means of the latch assembly.

19. A latch assembly according to claim 18, wherein the housing means further includes both an opening therein defining a cavity adapted for receiving the handle means in the closed position thereof and flange means, with the housing flange means and handle means both being provided with substantially flat outer surfaces which are contiguous with each other when the handle means is in the closed position.

20. A latch assembly according to claim 18, wherein the handle means is provided with an aperture therein engageable by an operator to accomodate movement by the operator from the closed position to the open position.

21. A latch assembly according to claim 18, further including locking means adapted for retaining the handle means in the closed position.

22. A latch assembly according to claim 18, wherein the housing means further includes flange means extending outwardly a sufficient amount therefrom adapted for engaging an outside surface of the first member for preventing the passage of matter around the latch assembly and through the aperture in the first member when the latch assembly is mounted therein.

23. A latch assembly according to claim 18, wherein the housing means further includes a first end and a second end, and the handle means includes a first end and a second end along a longitudinal axis thereof, wherein the first end of the handle means is positioned adjacent the first end of the housing means in the closed position of the handle means.

24. A latch assembly according to claim 18, wherein the handle means is pivotally secured by a pivot pin to the slide means and includes therein a generally elongated cavity through which the pivot pin passes, with the generally elongated cavity including as portions thereof a first end and a second end, the pivot pin being adjacent the first end of the generally elongated cavity in the opened position of the handle means and adjacent the second end of the generally elongated cavity in the closed position of the handle means.

25. A latch assembly according to claim 18, further including means for imparting movement to the handle means in a direction generally along a longitudinal axis of the handle means upon the closing and the opening thereof.

26. A latch assembly according to claim 25, wherein the movement of the handle means is forward along the longitudinal axis thereof toward a first end of the handle means upon the pivotal movement of the handle means from the opened to the closed position, and wherein the movement of the handle means is rearward along the longitudinal axis thereof toward a second end of the handle means upon the pivotal movement of the handle means from the closed to the opened position.

27. A latch assembly according to claim 25, wherein the handle means further includes cam means adapted for facilitating the longitudinal movements of the handle means.

28. A latch assembly according to claim 27, further including biasing means associated with the cam means adapted for both providing additional resistance to the handle means upon movement between the opened and the closed positions and for restricting the movement of the handle means when in the closed position thereof.

29. A latch assembly according to claim 28, wherein the biasing means is a spring member integral with the cam means.

30. A latch assembly according to claim 27, wherein the cam means includes a first cam surface for facilitating movement of the handle means longitudinally forward toward a first end of the housing means during the closing thereof and a second cam surface for facilitating movement of the handle means longitudinally rearward toward a second end of the housing means during the opening thereof.

31. A latch assembly according to claim 18, further including cam means adapted for facilitating movement of the handle means from the closed to the opened position, whereby upon actuation by an operator downward on the latch assembly adjacent a first end the handle means, a second end of the handle means is moved upwardly a sufficient amount from the closed position to a position in which the operator is capable of grabbing the handle means for movement to the opened position.

32. A latch assembly according to claim 31, further including biasing means associated with the cam means adapted for both providing additional resistence to the handle means upon movement between the opened and the closed positions and for restricting the movement of the handle means when in the closed position thereof.

33. A latch assembly according to claim 32, wherein the biasing means is a spring member integral with the cam means.

34. A latch assembly for mounting in an aperture formed in a first member adapted for developing a compressive force between the first member and a corresponding second member for releasably retaining the first member against the second member and in a latched position, the latch assembly comprising:

housing means adapted for being received within the aperture of the first member and including as portions thereof an aperture extending therethrough, a first end and a second end;

slide means adapted to project through the aperture of the housing means, movable axially and rotatably therein;

pawl means associated with the slide means and adapted for axial and rotatable movement corresponding with movement of the slide means for releasably retaining the second member;

handle means pivotally attached to the slide means and having as portions thereof a first end and a second end, the handle means being adapted to facilitate movement of the slide means and pawl means axially as the handle means is pivotally moved between closed and opened positions, the pawl means engaging the second member in the latched position when the handle means is pivoted to its closed position;

means for imparting movement to the handle means in a direction generally along a longitudinal axis of the handle means upon the closing and the opening thereof, wherein the movement of the handle means is forward along the longitudinal axis thereof upon the pivotal movement of the handle means from the opened to the closed position, and wherein the movement of the handle means is rearward along the longitudinal axis thereof upon the pivotal movement of the handle means from the closed to the opened position, the first end of the handle means being positioned adjacent the first end of the housing means in the closed position thereof, wherein the handle means is pivotally secured by a pivot pin to the slide means and includes therein a generally elongated cavity through which the pivot pin passes, with the generally elongated cavity including as portions thereof a first end and a second end at a spaced separation and the spaced separation being generally greater than a diameter of the pivot pin, the pivot pin being closer to the first end of the generally elongated cavity than the second end thereof in the opened position of the handle means and closer to the second end of the generally elongated cavity than the first end thereof in the closed position of the handle means for imparting said movement to the handle means;

the handle means being rotatably movable when in the opened position for facilitating rotatable movement of the pawl means via the slide means away from the second member and into an unlatched position; and means adapted for both sealing the aperture of the housing means so as to prevent the passage of matter therethrough and for biasing the slide means axially downward so as to urge the handle means into contact with the housing means upon pivotal movement thereof.

35. A latch assembly according to claim 34, wherein the housing means further includes both an opening therein defining a cavity adapted for receiving the handle means in the closed position thereof and flange means, with the housing flange means and handle means both being provided with substantially flat outer surfaces which are contiguous with each other when the handle means is in the closed position.

36. A latch assembly according to claim 34, wherein the handle means is provided with an aperture therein engageable by an operator to accomodate movement by the operator from the closed position to the open position.

37. A latch assembly according to claim 34, further including locking means adapted for retaining the handle means in the closed position.

38. A latch assembly according to claim 34, further comprising support means associated with the slide means adapted to retain the sealing and biasing means in a position abutting the housing means of the latch assembly.

39. A latch assembly according to claim 38, wherein the sealing and biasing means is an elastic member adapted to be compressed by the support means against the housing means of the latch assembly.

40. A latch assembly according to claim 34, wherein the housing means further includes flange means extending outwardly a sufficient amount therefrom adapted for engaging an outside surface of the first member for preventing the passage of matter around the latch assembly and through the aperture in the first member when the latch assembly is mounted therein.

41. A latch assembly according to claim 34, wherein the handle means further includes cam means adapted for facilitating the longitudinal movements of the handle means.

42. A latch assembly according to claim 41, wherein the cam means includes a first cam surface for facilitating movement of the handle means longitudinally forward toward the first end of the housing means during the closing thereof and a second cam surface for facilitating movement of the handle means longitudinally rearward toward the second end of the housing means during the opening thereof.

43. A latch assembly according to claim 41, further including biasing means associated with the cam means adapted for both providing additional resistence to the handle means upon movement between the opened and the closed positions and for restricting the movement of the handle means when in the closed position thereof.

44. A latch assembly according to claim 43, wherein the biasing means is a spring member integral with the cam means.

45. A latch assembly according to claim 34, further including cam means adapted for facilitating movement of the handle means from the closed to the opened position, whereby upon actuation by an operator downward on the latch assembly adjacent a first end the handle means, a second end of the handle means is moved upwardly a sufficient amount from the closed position to a position in which the operator is capable of grabbing the handle means for movement to the opened position.

46. A latch assembly according to claim 45, further including biasing means associated with the cam means adapted for both providing additional resistance to the handle means upon movement between the opened and the closed positions and for restricting the movement of the handle means when in the closed position thereof.

47. A latch assembly according to claim 46, wherein the biasing means is a spring member integral with the cam means.

* * * * *